US006053784A

United States Patent [19]

Takahashi

[11] Patent Number: 6,053,784

[45] **Date of Patent: *Apr. 25, 2000**

[54] COOLING SYSTEM FOR OUTBOARD MOTOR

[75] Inventor: Masanori Takahashi, Hamamatsu, Japan

[73] Assignee: Sanshin Kogyo Kabushiki Kaisha, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/995,681

[22] Filed: Dec. 22, 1997

[30] Foreign Application Priority Data

Dec. 20, 1996 [JP] Japan ..... 8-341813

[51] Int. Cl.[7] ..... B63H 21/38

[52] U.S. Cl. ..... 440/88; 123/41.08; 123/41.14

[58] Field of Search ..... 440/88; 123/41.08, 123/41.14

[56] References Cited

U.S. PATENT DOCUMENTS

| | | | |
|---|---|---|---|
| 3,908,579 | 9/1975 | Miller et al. | 440/88 |
| 4,399,797 | 8/1983 | Iwai . | |
| 4,588,385 | 5/1986 | Suzuki et al. . | |
| 4,604,069 | 8/1986 | Taguchi | 440/88 |
| 4,857,023 | 8/1989 | Takashima . | |
| 4,976,462 | 12/1990 | Hirata et al. . | |
| 4,991,546 | 2/1991 | Yoshimura . | |
| 4,997,399 | 3/1991 | Nakayasu et al. . | |
| 5,009,622 | 4/1991 | Dudney | 440/88 |
| 5,036,804 | 8/1991 | Shibata . | |
| 5,330,376 | 7/1994 | Okumura . | |
| 5,334,063 | 8/1994 | Inoue et al. . | |
| 5,487,688 | 1/1996 | Sumigawa | 440/88 |
| 5,555,855 | 9/1996 | Takahashi . | |
| 5,628,285 | 5/1997 | Logan et al. | 440/88 |
| 5,713,771 | 2/1998 | Takashi et al. . | |
| 5,769,038 | 6/1998 | Takahashi et al. | 123/41.82 R |

*Primary Examiner*—Sherman Basinger
*Attorney, Agent, or Firm*—Knobbe, Martens, Olson & Bear, LLP

[57] ABSTRACT

A cooling system for an outboard motor having a water propulsion device and an internal combustion engine positioned in a cowling, the engine having an output shaft arranged to drive the water propulsion device, is disclosed. The cooling system includes a coolant delivery mechanism driven by the engine, the delivery mechanism arranged to deliver coolant of at least one coolant passage of the engine. The cooling system also includes at least one coolant drain line through which coolant may drain from the engine and a control which controls the flow of coolant through the drain line after the engine is stopped.

20 Claims, 2 Drawing Sheets

COOLING SYSTEM FOR OUTBOARD MOTOR

FIELD OF THE INVENTION

The present invention relates to a cooling system. More particularly, the invention is an improved cooling system for an outboard motor having a water propulsion device powered by an internal combustion engine.

BACKGROUND OF THE INVENTION

As is well known, outboard motors for use in powering watercraft include an engine powering a water propulsion apparatus of the motor, such as a propeller. These outboard motors have a cowling which encloses the engine.

The motor is generally movably mounted to a stern of a watercraft, and as such, it is desirable that the motor be compact in dimension. Keeping the motor compact reduces air drag and reduces the force necessary to turn or trim the motor. In order that the outboard motor be small in dimension, the engine is arranged to be as compact as possible, and the cowling is sized to fit just around the engine.

The positioning of the engine in the small space defined by the cowling is beneficial when considering the above-stated goals, but creates several problems. A main problem is that the cowling traps significant heat generated by the engine. The high temperatures in the engine may damage components associated with the engine. For example, engine electrical features are often quite sensitive to high temperature conditions.

This heating problem is especially acute when the engine is stopped. In particular, some air normally flows through the cowling when the engine is running, induced by the intake of the engine, the movement of the motor through the air or the like. In addition, the engine may include a liquid cooling system arranged to draw cool water from the body of water in which the motor is operating and deliver it through cooling passages to the engine. This air flow and the flow of liquid coolant stops when the engine stops. In the liquid cooling systems, when the engine stops powering a coolant supply pump, the coolant in the engine cooling passages drains from the engine. At this time, the heat associated with the engine block, head, lubricant and the like is transmitted to the stagnant air in the cowling and the engine accessories and components.

An improved cooling system for an outboard motor having a water propulsion device powered by an internal combustion engine, is desired.

SUMMARY OF THE INVENTION

In accordance with the present invention, there is provided a cooling system for an outboard motor. Preferably, the motor is of the type which has a powerhead comprising an internal combustion positioned in a cowling. The motor includes a water propulsion device which is powered by the engine.

The cooling system includes a coolant delivery mechanism driven by the engine, the delivery mechanism arranged to deliver coolant through at least one coolant passage through the engine. The cooling system also includes at least one coolant drain line through which coolant may drain from the engine and a control which controls the flow of coolant through the drain line after the engine is stopped. In a preferred arrangement, the control comprises a valve positioned along the coolant drain.

The control is arranged to prevent the flow of coolant through the drain line from the engine in a first arrangement for a predetermined time after the engine has stopped. In a second arrangement, the control is arranged to prevent the flow of coolant through the drain line from the engine until the temperature of the engine falls below a predetermined temperature.

The cooling system of the present invention is arranged to maintain coolant in the coolant passages of the engine even after the engine has stopped. In this manner, the cooler coolant in the engine absorbs heat from the engine after it has stopped, reducing the immediate rate of heat transfer from the engine to accessories and the air within the cowling, keeping the temperature within the cowling lower.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

Figure 1:
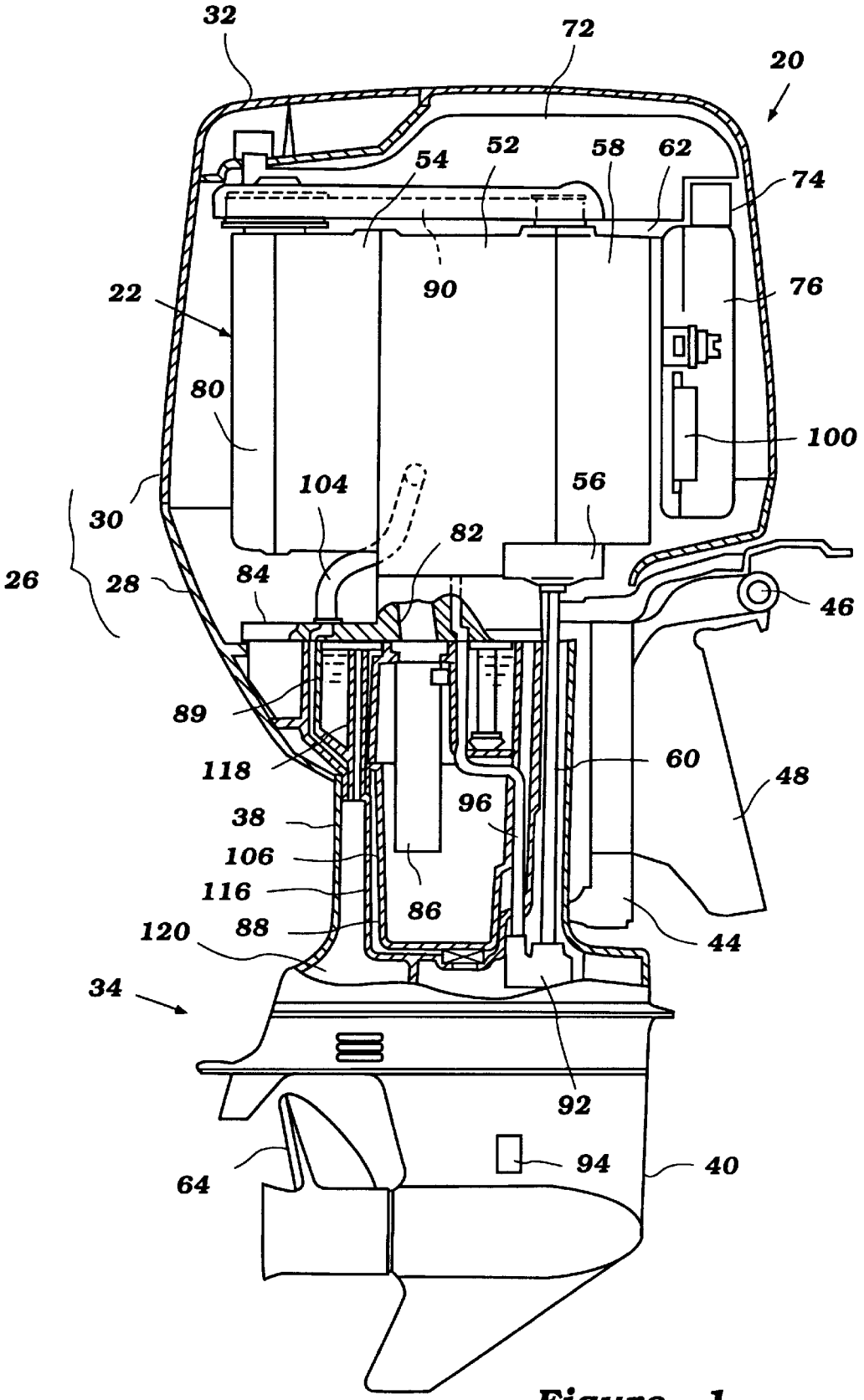
FIG. 1 is a cross-sectional side view of an outboard motor having a water propulsion device powered by an engine positioned in a cowling of the motor, the motor having a cooling system arranged in accordance with the present invention.

In accordance with the present invention, and referring generally to FIG. 1, there is provided a cooling system for an outboard motor 20. The cooling system is preferably arranged to maintain coolant within one or more cooling passages for cooling the engine after the engine has stopped running. The cooling system of the present invention is described for use in cooling an outboard motor 20 since this is an application for which the cooling system has particular advantages. Those of skill in the art will appreciate that the cooling system may be adapted for use in a variety of other applications.

Referring to FIG. 1, the outboard motor 20 has a powerhead 26 comprised of a lower tray portion 28 and a main cowling portion 30. An engine 22 is positioned in the powerhead 26 of the motor 20. An air inlet 32 is provided in the main cowling portion 30 for providing air to the engine 22 therein. The motor 20 includes a lower unit 34 extending downwardly from the cowling portion 30. The lower unit 34 comprises an upper or "drive shaft housing" section 38 and a lower section 40.

The motor 20 is arranged to be movably mounted to a watercraft (not shown). Preferably, the motor 20 is connected to a steering shaft (not shown). The steering shaft is supported for steering movement about a vertically extending axis within a swivel or swivel bracket 44. The mounting of the motor 20 via the steering shaft with respect to the swivel bracket 44 permits the motor 20 to be rotated about the vertically extending axis through the swivel bracket 44. In this manner, the motor 20 may be turned to direct the watercraft which it is used to propel.

The swivel bracket 44 is connected by means of a pivot pin 46 to a clamping bracket 48 which is adapted to be attached to a transom portion of a hull of a watercraft. The pivot pin 46 permits the outboard motor 20 to be trimmed and tilted up about the horizontally disposed axis formed by the pivot pin 46.

Referring to FIG. 1, the powerhead 26 of the outboard motor 20 includes the engine 22 which is positioned within the main cowling portion 30. The engine 22 is preferably of the four-cylinder variety, arranged in in-line fashion and operating on a four-cycle operating principle. As may be appreciated by those of skill in the art, the engine 22 may have a greater or lesser number of cylinders, such as two, six, or eight or more. In addition, the engine 22 may have its cylinders arranged in "V", opposing or other arrangements, and the engine 22 may operate on a two-cycle or other principle.

In the preferred arrangement, the engine 22 has a cylinder block 52 with a cylinder head 54 connected thereto and cooperating therewith to define the four cylinders. Though not illustrated, a piston is movably positioned in each cylinder, and connected to a connecting rod extending to a vertically extending crankshaft 56. Referring to FIG. 1, the crankshaft 56 is arranged to drive a drive shaft 60 which extends downwardly through the lower unit 34, where it is arranged to drive a water propulsion device of the motor 20.

Preferably, this water propulsion device comprises a propeller 64. The propeller 64 is preferably driven by the drive shaft 60 through a conventional forward-neutral-reverse transmission. The transmission is not illustrated herein, as its construction per se forms no part of the invention. Therefore, any known type of transmission may be employed. A control is preferably provided for allowing an operator to remotely control the transmission, such as from the watercraft.

The crankshaft 56 is journalled for rotation with respect to the cylinder block 52. A crankcase cover 58 engages an end of the block 52, defining therewith a crankcase 62 within which the crankshaft rotates. The crankcase cover 58 may be attached to the cylinder block 52 by bolts or similar means for attaching (not shown), as known to those skilled in the art.

The engine 22 includes an air intake system for providing air to each cylinder. As illustrated in FIG. 1, air passes through the intake 32 in the motor cowling 30 and through an air plenum 72 to an intake pipe 74. As illustrated, this air plenum 72 extends over a top end of the engine 22 within the cowling 30 from the rear of the engine 22 towards a front of the engine.

The intake pipe 74 extends downwardly to at least one surge tank 76. Though not shown, at least one air delivery passage leads from the surge tank 76 to each cylinder for providing air thereto.

As well known to those of skill in the art, means are provided for controlling the flow of air into each cylinder. This means may comprise at least one intake valve arranged to selectively open and close the air delivery passage leading to each cylinder. The valves are preferably moved with at least one camshaft (not shown) rotatably connected to the cylinder head 54 and positioned under a camshaft cover 80 connected to the cylinder head 54.

An exhaust system is provided for routing the products of combustion within the cylinders to a point external to the engine 22. Preferably, an exhaust passage (not shown) leads from each cylinder into a main exhaust passage defined by the engine 22 which extends to a bottom end of the engine 22. This main exhaust passage is aligned at the bottom end of the engine 22 with an aligned passage 82 in an exhaust guide 84 positioned at the bottom end of the engine 22.

An exhaust pipe 86 extends downwardly from the passage 82 in the exhaust guide 84. The exhaust pipe 86 terminates in an expansion chamber 88 positioned within the drive shaft housing portion 36 of the lower unit 34. Exhaust is preferably routed from the expansion chamber 88 to a point external to the motor 20, such as through a through-the-propeller hub discharge passage.

Means are also provided for controlling the flow of exhaust from each cylinder to its respective exhaust passage. This means may comprise at least one exhaust valve as well known to those of skill in the art. Like the intake valves, the exhaust valves may be actuated by a camshaft journalled for rotation with respect to the cylinder head 54 and enclosed within the camshaft cover 80.

When at least one camshaft is used to drive intake and/or exhaust pulleys, means are also provided for rotating the camshaft(s). As best illustrated in FIG. 1, this means may comprise a flexible transmitter such as a belt 90 driven by the camshaft 56 and driving the camshaft(s).

A fuel delivery system is provided for delivering fuel to each cylinder for combustion therein. The fuel delivery system preferably includes a fuel tank (not shown) and a fuel pump (not shown) for pumping fuel from the tank and delivering it to at least one charge former (such as a fuel injector or carburetor, not shown) which delivers fuel to each cylinder. The fuel system may be arranged in a variety of manners known to those of skill in the art.

A suitable ignition system is provided for igniting an air and fuel mixture within each cylinder. Such systems are well known to those skilled in the art, and as the ignition system forms no part of the invention herein, such is not described in detail here.

The motor 20 includes a lubricating system for lubricating various parts of the engine 22. Preferably, the lubricating system includes an oil pan or tank 89 positioned below the engine 22 and preferably attached to the exhaust guide 84. Lubricant is drawn from the tank 89 by a lubricant pump (not shown) and delivered to one or more parts of the engine 22 before returning to the tank 89 through one or more return or drain passages.

In accordance with the present invention, the motor 20 includes a cooling system. The cooling system is preferably arranged to cool the engine 22 with cooling liquid, preferably in the form of water from the body of water in which the motor 20 is positioned. Means are provided for delivering this cooling water to the engine 22. Preferably, this means comprises a water pump 92.

As best illustrated in FIG. 1, the water pump 92 is positioned in the lower unit 34. The pump 92 is preferably driven by the drive shaft 60, and draws water from the body of water in which the motor 20 is operating through an intake pipe 95 (see FIG. 2) from an inlet 94, and expels it upwardly through a cooling liquid supply pipe 96.

Figure 2:
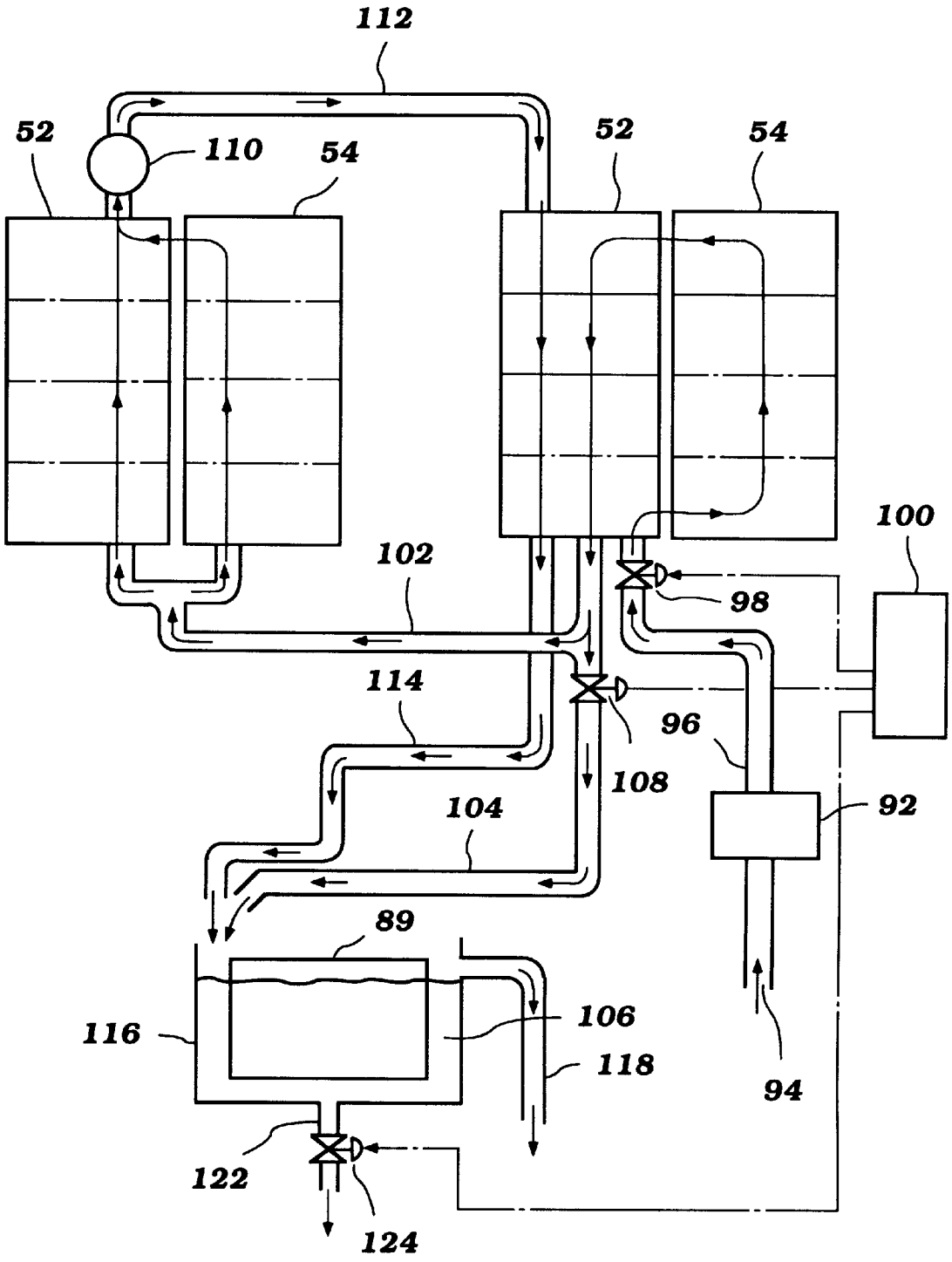
FIG. 2 is schematic illustrating the cooling system of the outboard motor illustrated in FIG. 1.

Referring to FIG. 2, the cooling system is illustrated in more detail. As illustrated therein, the cooling liquid delivered through the supply pipe 96 selectively passes through a first cooling path formed through the cylinder head 52 and block 54. Preferably, means are provided for controlling the flow of cooling liquid passing through the pipe 96. As illustrated, this means comprises a first valve 98.

Means are provided for controlling the first valve 98 so as to selectively permit cooling liquid to flow into the engine 22 and to prevent the reverse flow of coolant in the engine 22 back towards the pump 92. Preferably, this means comprises an electronic control unit 100 arranged to control an electrically powered actuator associated with the valve 98.

The cooling liquid which is permitted to flow through the valve 98 preferably flows first through the cylinder head 54 and then through the cylinder block 52. Preferably, the coolant path through this portion of the block 52 and head 54 is for cooling primarily that portion of the cylinder head 54 defining the exhaust passages therethrough, and that portion of the block 52 defining the main exhaust passage leading to the passage 82 through the exhaust guide 84.

The cooling liquid then selectively flows through a first re-delivery line 102 to a second cooling liquid path through the engine 22, or through a first return line 104 to a coolant pool 106.

Means are provided for controlling the flow of cooling liquid through the return line 104. Preferably, this means comprises a second valve 108 positioned along the return line 104. The second valve 108 is arranged to selectively permit cooling liquid to flow through the return line 104.

Means are provided for controlling the second valve 108. Preferably, this means comprises the same electronic control unit 100 which is used to control the first valve 98.

The cooling liquid which flows through the first re-delivery line 102 is preferably divided and flows through a second flow path through the cylinder block 52 and head 54.

Means are preferably provided for preventing the flow of cooling liquid along the second flow path through the cylinder block 52 and head 54. Preferably, this means comprises a thermostat 110 positioned along the coolant path. As illustrated, the thermostat 110 is positioned along a second re-delivery line 112 which extends from the second coolant paths through the cylinder block 52 and head 54 to a third coolant path through the cylinder block 52 only.

The thermostat 110 is preferably arranged to close and prevent the flow of cooling liquid through the second re-delivery line 112 when the temperature of the engine 22 (and thus the cooling liquid) is low, permitting the engine to warm up. On the other hand, when the temperature of the engine 22 is high, the thermostat 110 opens, permitting cooling liquid to flow therethrough and cool the engine 22.

When the thermostat 110 is open and the second valve 108 is positioned to divert cooling liquid to the first re-delivery passage 102, cooling liquid flows through the second coolant path through the cylinder block 52 and head 54 and through the second re-delivery passage 112. This cooling liquid flows through the third coolant path through the engine 22, which preferably passes through the cylinder block 52 only. The cooling liquid is then routed through a second return line 114 to the coolant pool 106.

As illustrated in FIG. 1, the coolant pool 106 is formed in a space between a wall 116 and a wall which defines the oil pan 89. The cooling liquid in the cooling pool 106 thus cools the lubricant in the oil pan 89.

Means are provided for selectively permitting the cooling liquid which flows through the return lines 104,114 to the pool 106 to selectively fill the coolant pool. Preferably, this means comprises a valve 124 which controls the flow of cooling liquid through a bottom drain 122. The bottom drain 122 is a passage leading through the wall 116 at or near its lowest point within the lower unit 34.

Means are provided for controlling the drain valve 124 between a first position in which cooling liquid is permitted to flow through the drain 122 and a second position in which the drain 122 is closed and the cooling liquid fills the coolant pool 106. Preferably, this means comprises the electronic control unit 100.

When the drain valve 124 permits cooling liquid to flow through the drain 122, the coolant pool 106 does not fill with coolant, and instead the cooling liquid drains therethrough and is preferably routed back to the body of water in which the motor 20 is operating.

When the drain valve 124 prevents cooling liquid to flow through the drain 122, the cooling liquid fills the coolant pool 106. When the coolant pool 106 is full, cooling liquid is diverted therefrom through an overflow line 118. Preferably, the cooling liquid flows over a weir into the overflow line 118 which extends downwardly to a drain area 120 in the lower unit 34 which leads to a point external to the motor 20.

As stated above, the control unit 100 is arranged to control the position of the first, second and drain valves 98,108,124. In accordance with the present invention, the control unit 100 is arranged to control these valves as follows.

Preferably, the control unit 100 is arranged to control the valves 98,108,124 to prevent the coolant from draining from at least some of the coolant passages through the engine 22 and most preferably also from the pool 106 surrounding the oil pan 89 when the engine is stopped. In a first arrangement, the valves 98,108,124 are closed to prevent the coolant from draining from the coolant passages through the engine 22 and the coolant pool 106 until a fixed period of time after the engine has been stopped.

In a second arrangement, the valves 98,108 are closed to prevent the coolant from draining from the coolant passages through the engine 22 and the coolant pool 106 until the temperature of the engine 22 is cools at or below a predetermined temperature, such as to the ambient air temperature. In this arrangement, a temperature sensor (not shown) preferably provides a signal to the control unit 100. In this arrangement, the temperature of the air within the cowling 30 may be sensed instead of the temperature of the engine 22.

In accordance with the present invention, when the engine 22 is stopped, coolant is retained in the coolant pool 106 and the coolant passages through the engine 22 until the engine 22 has cooled down. In this manner, the cooler coolant absorbs heat from the engine 22 and the lubricant, preventing its immediate transmission to the engine accessories and air within the cowling 30. The rate of heat transmission to these components is thus reduced when the engine is stopped, as compared to the situation in which the coolant is permitted to drain from the engine, keeping the temperature of the air in the cowling, and thus the engine accessories and features low.

Those of skill in the art will appreciate that the above-described coolant flow path through the engine 22 is a preferred flow path and that the present invention may be adapted to cooling systems having flow paths which differ from that described above.

In addition, the cooling system may be of a closed-loop type in which coolant is circulated from a coolant supply tank through the engine. Those of skill in the art will appreciate that the present invention may be adapted to such a system to prevent the coolant from draining to the tank when the engine is stopped.

Of course, the foregoing description is that of preferred embodiments of the invention, and various changes and modifications may be made without departing from the spirit and scope of the invention, as defined by the appended claims.

What is claimed is:

1. A cooling system for an outboard motor having a water propulsion device and an internal combustion engine positioned in a cowling, the engine having an output shaft arranged to drive said water propulsion device, said cooling system including a coolant delivery mechanism driven by said engine for drawing water from a body of water in which said outboard motor is operating and returning the drawn water back to the body of water, said delivery mechanism arranged to deliver coolant through at least one coolant passage in said engine, at least one coolant drain line through which coolant may drain from said coolant passage in said engine, and means for controlling the flow of coolant from said engine through said drain line after said engine is stopped for selectively retaining coolant in said engine and for draining coolant from said engine in response to predetermined conditions.

2. The cooling system in accordance with claim 1, wherein said means for controlling comprises at least one valve positioned along said drain line.

3. The cooling system in accordance with claim 2, wherein said means for controlling further includes a control unit for moving said valve between a first position in which coolant is permitted to flow through said drain line and a second position in which coolant is prevented from flowing through said drain line.

4. The cooling system in accordance with claim 3, wherein said control unit is arranged to move said valve to said second position after said engine is stopped until a temperature of said engine is less than a predetermined temperature.

5. The cooling system in accordance with claim 3, wherein the predetermined condition is time.

6. The cooling system in accordance with claim 5, wherein the coolant is retained in the engine for a predetermined time after the engine has stopped running.

7. The cooling system in accordance with claim 6, wherein the coolant is drained from the engine after the predetermined time has passed.

8. The cooling system in accordance with claim 3, wherein the predetermined condition is temperature.

9. The cooling system in accordance with claim 8, wherein the coolant is retained in the engine until the temperature of the engine has fallen below a predetermined value.

10. The cooling system in accordance with claim 9, wherein the coolant is drained from the engine after the temperature has fallen below the predetermined temperature.

11. The cooling system in accordance with claim 1, wherein said motor further includes an oil pan, said cooling system including a coolant pool surrounding at least a portion of said oil pan for cooling oil in said pan.

12. The cooling system in accordance with claim 11, further including a discharge line leading from said coolant pool and means for controlling the flow of coolant from said pool through said discharge line.

13. The cooling system in accordance with claim 1, wherein said coolant delivery mechanism comprises a coolant pump powered by said output shaft of said engine.

14. A cooling system for an outboard motor having a water propulsion device and an internal combustion engine positioned in a cowling, the engine having an output shaft arranged to drive said water propulsion device, said cooling system including a coolant delivery mechanism driven by said engine, said delivery mechanism arranged to deliver coolant through at least one coolant passage in said engine, at least one coolant drain line through which coolant may drain from said coolant passage in said engine, and means comprising at least one valve positioned along said drain line for controlling the flow of coolant from said engine through said drain line after said engine is stopped, said means for controlling including a control unit for moving said valve between a first position in which coolant is permitted to flow through said drain line and a second position in which coolant is prevented from flowing through said drain line, said control unit being arranged to move said valve to said second position for a predetermined amount of time after said engine is stopped.

15. A cooling system for an outboard motor having a water propulsion device and an internal combustion engine positioned in a cowling, the engine having an output shaft arranged to drive said water propulsion device and an oil pan, said cooling system including a coolant delivery mechanism driven by said engine and a coolant pool surrounding at least a portion of said oil pan for cooling oil in said pan, said delivery mechanism arranged to deliver coolant through at least one coolant passage in said engine, at least one coolant drain line through which coolant may drain from said coolant passage in said engine to said coolant pool, a discharge line leading from said coolant pool and means for controlling the flow of coolant from said coolant pool through said discharge line, and means for controlling the flow of coolant from said coolant pool through said discharge line after said engine is stopped, in said means for controlling comprises a valve positioned along said discharge line.

16. A method of cooling an engine comprised of at least a cylinder block and a cylinder head at least one of which has at least one coolant passage and powering a water propulsion device of an outboard motor and positioned in a cowling of the motor, comprising the steps of starting said engine; powering a coolant delivery mechanism with said engine for drawing water from a body of water in which said outboard motor is operating; delivering the drawn water through said at least one coolant passage of said engine; stopping said engine; stopping said coolant delivery mechanism; and preventing the flow of coolant from said at least one coolant passage of said engine back to the body of water.

17. A method of cooling an engine powering a water propulsion device of an outboard motor and positioned in a cowling of the motor, comprising the steps of starting said engine; powering a coolant delivery mechanism with said engine for drawing water from a body of water in which said outboard motor is operating; delivering the drawn water through at least one coolant passage of said engine; stopping said engine; stopping said coolant delivery mechanism; and preventing the flow of coolant from said coolant passage of said engine back to the body of water through the step of closing a valve positioned along a drain line leading from said coolant passage.

18. A method of cooling an engine powering a water propulsion device of an outboard motor and positioned in a cowling of the motor, comprising the steps of starting said engine; powering a coolant delivery mechanism with said engine for drawing water from a body of water in which said outboard motor is operating; delivering the drawn water through at least one coolant passage of said engine; stopping said engine; stopping said coolant delivery mechanism; and preventing the flow of coolant from said coolant passage of said engine back to the body of water by preventing the flow of coolant from said coolant passage until a temperature of said engine is below a predetermined temperature.

19. A method of cooling an engine powering a water propulsion device of an outboard motor and positioned in a cowling of the motor, comprising the steps of starting said engine; powering a coolant delivery mechanism with said engine for drawing water from a body of water in which said outboard motor is operating; delivering the drawn water through at least one coolant passage of said engine; stopping said engine; stopping said coolant delivery mechanism; and preventing the flow of coolant from said coolant passage of said engine back to the body of water until a predetermined time after said engine has stopped, and then permitting said coolant to flow from said coolant passage.

20. A cooling system for an outboard motor having a water propulsion device and an internal combustion engine positioned in a cowling, the engine having an output shaft arranged to drive said water propulsion device, said cooling system including a coolant delivery mechanism driven by said engine for circulating coolant through the paths of cooling jackets for said engine, said engine having a first portion comprised of one of a cylinder head and a cylinder block and a second portion comprised of the other of said cylinder head and said cylinder block, said first portion having separate, first and second cooling jackets, said paths including a first path through said first cooling jacket of said first portion of said engine, a second path extending through said second cooling jacket of said first portion of said engine and a third path through a third cooling jacket of said second engine portion, and valve means for selectively controlling the flow from said first cooling jacket either to said second cooling jacket through said third path, or for returning the coolant to the body of water in which the outboard motor is operating without flowing through said third path.

* * * * *

UNITED STATES PATENT AND TRADEMARK OFFICE

CERTIFICATE OF CORRECTION

PATENT NO. : 6,053,784

DATED : April 25, 2000

INVENTOR(S) : Masanori Takahashi

It is certified that error appears in the above-identified patent and that said Letters Patent is hereby corrected as shown below:

Column 8, line 24, Claim 15, delete "in" and substitute -- and --.

Column 8, line 33, Claim 16, delete "a" and substitute -- the --.

Column 8, line 34, Claim 16, delete "said".

Column 8, lines 36 and 37, delete "at least one".

Signed and Sealed this

Eighth Day of May, 2001

*Attest:*

Nicholas P. Godici

NICHOLAS P. GODICI

*Attesting Officer*

*Acting Director of the United States Patent and Trademark Office*